United States Patent [19]

O'Malley et al.

[11] Patent Number: 4,670,745

[45] Date of Patent: Jun. 2, 1987

[54] VIDEO DISPLAY ADDRESS GENERATOR

[75] Inventors: Patrick J. O'Malley, Chandler; William M. Peterson, Tempe, both of Ariz.

[73] Assignee: Motorola Inc., Schaumburg, Ill.

[21] Appl. No.: 551,811

[22] Filed: Nov. 15, 1983

[51] Int. Cl.[4] ..... G09G 1/16

[52] U.S. Cl. ..... 340/801; 340/723; 340/726; 340/789

[58] Field of Search ..... 340/723, 724, 725, 726, 340/744, 789, 798, 799, 801

[56] References Cited

U.S. PATENT DOCUMENTS

| | | | |
|---|---|---|---|
| 4,375,638 | 3/1983 | O'Keefe et al. | 340/726 |
| 4,437,093 | 3/1984 | Bradley | 340/726 |
| 4,489,317 | 12/1984 | Shiga | 340/723 |
| 4,491,834 | 1/1985 | Oguchi | 340/723 |

*Primary Examiner*—Gerald L. Brigance
*Assistant Examiner*—Jeffery A. Brier
*Attorney, Agent, or Firm*—Dale E. Jepsen

[57] ABSTRACT

A video raster display system having a dedicated display address generator is provided. In addition to a microprocessor contained within the video display system providing addresses to a memory the display address generator also generates addresses. The display address generator has a logic unit having a first and a second bus as inputs. A first plurality of registers, some of which are controllably coupled to said first bus and some of which are controllably coupled to said second bus, receives inputs from the microprocessor. A second plurality of registers, some of which are controllably coupled to said first bus and some of which are controllably coupled to said second bus, receives inputs from a video data generator. A third plurality of registers, some of which are controllably coupled to said first bus and some of which are controllably coupled to said second bus, receives the output from the logic unit to controllably provide this output to the logic unit for subsequent operations.

9 Claims, 2 Drawing Figures

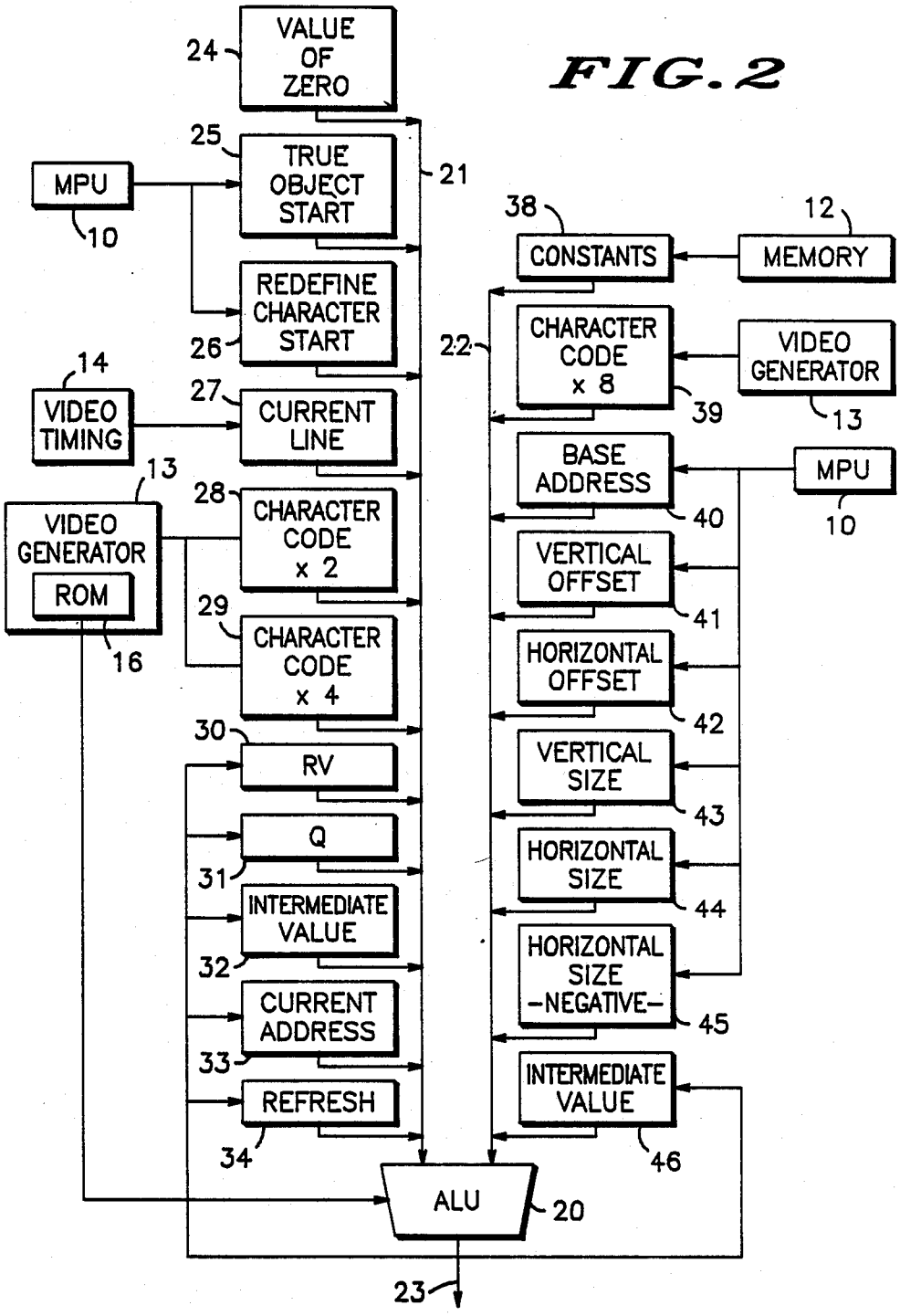
FIG. 2
VALUE OF ZERO
24
TRUE OBJECT START
25
MPU
10
21
REDEFINE CHARACTER START
26
14
VIDEO TIMING
27
CURRENT LINE
13
VIDEO GENERATOR
ROM
16
28
CHARACTER CODE x 2
29
CHARACTER CODE x 4
30
RV
Q
31
INTERMEDIATE VALUE
32
CURRENT ADDRESS
33
REFRESH
34
ALU
20
23
38
CONSTANTS
12
MEMORY
22
CHARACTER CODE x 8
39
VIDEO GENERATOR
13
BASE ADDRESS
40
MPU
10
VERTICAL OFFSET
41
HORIZONTAL OFFSET
42
VERTICAL SIZE
43
HORIZONTAL SIZE
44
HORIZONTAL SIZE -NEGATIVE-
45
INTERMEDIATE VALUE
46

VIDEO DISPLAY ADDRESS GENERATOR

BACKGROUND OF THE INVENTION

This invention relates, in general, to video display systems, and more particularly, to a video display address generator.

There are many video scan display systems available. These video systems are capable of displaying characters such as used in text material as well as images of scenes. Video display systems having means for displaying data characters as well as for modifying the video characteristics of the displayed characters are known in the art. Typically such systems have a fixed number of video modifications that can be made. Such modifications or enhancements usually deal with other than pel modifications. "Pel" refers to the particular horizontal and vertical screen resolution of the display system which is the smallest picture element on the screen that can be controlled by data in the memory. Many of these prior art systems although having various capabilities did not have all the features desirable in today's market incorporated into a practical system.

Accordingly, it is an object of the present invention to provide an improved video display address generator for a video display system.

Another object of the present invention is to provide a video display address generator which allows new hardware techniques to more efficiently implement functions of a complex display address generator.

A further object of the present invention is to provide a display address generator useful in generating addresses for horizontal and vertical scrolling, refreshing a memory, and supporting a large variety of virtual screen sizes.

SUMMARY OF THE INVENTION

The above and other objects and advantages of the present invention are achieved by a video display system having a microprocessor unit, video timing, a video generator, memory, a video display, and a display address generator. The display address generator comprises a logic unit having a plurality of registers coupled thereto. Some of the registers receive inputs from the microprocessor while yet others receive inputs from the video timing, video generator, as well as fixed inputs. Some of the registers receive outputs from the logic unit and controllably couple these outputs back to the logic unit. By controllably coupling selected registers to the logic unit an address is generated. The display address generator is capable of handling addresses for a scene which is wider and/or higher than the area of the display. The display address generator also permits vertical and horizontal scrolling.

BRIEF DESCRIPTION OF THE DRAWINGS

FIG. 2 is a block diagram of a display address generator useful in the system of FIG. 1.

Figure 1:
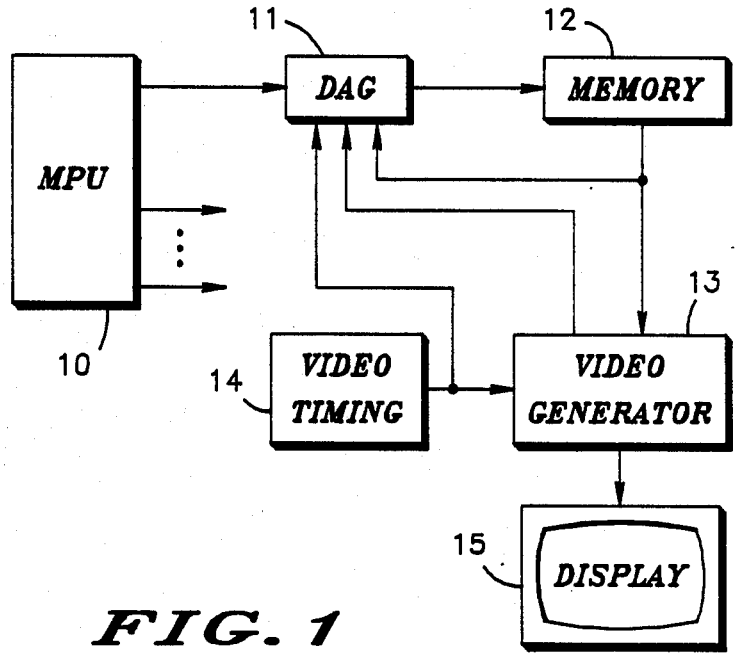
FIG. 1 is a general block diagram of a raster scan display system.

The exemplification set out herein illustrates the preferred embodiment of the invention in one form thereof, and such exemplification is not to be construed as limiting in any manner.

DETAILED DESCRIPTION OF THE DRAWINGS

FIG. 1 illustrates in block diagram form a raster scan display system using the present invention. A microprocessor 10 provides control signals for the raster scan display system. The connection of all of the outputs of the microprocessor 10 are not shown since they are not needed for an understanding of the present invention. Microprocessor 10 also provides outputs to display address generator 11. Display address generator 11 provides an output to memory system 12. Memory system 12 represents most of the memory required for the raster scan display system. The outputs of memory 12 go to display address generator 11 as well as to video data generator 13. Video generator 13 also receives inputs from video timing circuit 14. An output of video timing circuit 14 is also provided to display address generator 11. Video generator 13 provides outputs to display address generator 11 as well as to video display 15.

Memory 12 is capable of storing data for a scene much larger than can be displayed at one time on display 15. This larger scene is called a virtual screen whereas the portion that is displayed or is visible on display 15 is called the displayed screen. Display address generator 11 is capable of generating the addresses required to display the image shown on the displayed screen. This display address generator 11 is capable of providing the necessary addresses to scroll the scene being displayed in a vertical as well as a horizontal direction in order to pan within the limits of the virtual screen. Display address generator 11 is a combination of hardware and firmware used to calculate all non-MPU addresses. These calculated addresses are used to access the shared dynamic random access memory which is a portion of memory 12. The MPU can directly address memory 12 and these addresses are interleaved with the addresses generated by display address generator 11.

Display address generator 11 calculates video addresses in real time in a bit plane mode as well as a list mode. In the bit plane mode individual pels can be displayed whereas in the list mode, characters and other fixed objects are displayed. In the bit plane mode the virtual screen memory is arranged in scan lines, and within each scan line the color pointer of the first pel is followed by the color pointer of the second pel, and so forth. The characters and fixed objects used in the list mode are defined in image tables which contain their pel-by-pel description.

Display address generator 11 also fills other hardware registers at the very beginning of a scan line prior to the display scan reaching the edge of display 15. One such hardware register is a true object register which is used within the corresponding scan line. Another such hardware register is a list buffer which can be used on several scan lines. Display address generator 11 also ensures that the dynamic random access memory is refreshed, and it calculates address boundries to determine when the list buffer is full and when scroll wrap around occurs. Since the virtual screen is larger than the displayed screen it is arranged in a configuration so that wrap around can occur in both horizontal and vertical directions. In the embodiment illustrated in FIG. 1, display address generator 11 provides a 20-bit address signal.

FIG. 2 illustrates in block diagram form the hardware used in display address generator 11. Arithmetic and logic unit 20 has a bus 21 and 22 connected to its inputs and provides an output 23. Registers 24 through 34 are shown as being connected to bus 21 and registers 38 through 46 are shown as being connected to bus 22. Registers 24 through 34 and 38 through 46 are controllably connected to their busses so that at any given time only one register will be providing data to its respective bus. The output of ALU 20 is provided as inputs to registers 30 through 34 and to register 46. Register 24 is indicated as storing a value of zero; however, it will be noted that register 24 can be eliminated when the bus precharging system is such as to place all zeros on bus 21. The purpose of the zeros is to be able to add zero to the contents contained in one of the registers connected to bus 22. The purpose of this is to be able to transfer the contents from one of the registers connected to bus 22 to a register which has its input connected to the output of ALU 20, such as one of registers 30 through 34.

Register 25 receives inputs from MPU 10 (FIG. 1). These inputs to register 25 indicate the location in memory where the pattern for the true object starts. Register 26 also receives inputs from MPU 10 and these inputs indicate where the pattern for the redefinable characters start in memory 12. Register 27 is a current line register and receives inputs from video timing circuit 14. The data in register 27 indicates the location of the present scan line within a character. Register 28 is a character code (CC) times two register and contains a product of the character code multiplied by two. This product is generated by hardware within video data generator 13 (FIG. 1) and is multiplied outside of display address generator 11 in order to be able to provide a final result address in a shorter period of time. Register 29 is a character code times four register and receives an input from video data generator 13 and is used in the same manner as register 28. The only difference being that it contains the product of the character code times four.

Register 30 is the real vertical (RV) register and receives its input from ALU 20. When display address generator 11 starts generating an address, register 30 is set at zero and keeps track of the number of bytes in the current vertical direction. Should the number of bytes exceed the vertical height of the virtual screen a flag will be set to indicate that the address generated is off of the virtual screen. Register 31 (Q) receives its input from ALU 20 and serves the same function as register 30 except it is for the horizontal direction. Register 32 receives its input from ALU 20 and is a temporary storage for the output provided by ALU 20. Register 33 is a current address register and receives its input from ALU 20. The data in register 33 accumulates the vertical component of the location in memory of the character about to be displayed. Register 34 is a refresh register and is used in refreshing the random access memory portion of memory 12. Register 34 receives its input from ALU 20 and keeps track of the rows of memory cells within the random access memory which are refreshed to ensure that all the cells get refreshed.

Register 38 is used to store constants which are supplied to register 38 by a read only memory portion of memory 12. Register 38 provides outputs to bus 22 which is connected to an input of ALU 20. Register 39 is a character code times eight register and receives inputs from video data generator 13 and provides outputs to bus 22. Register 39 is similar to registers 28 and 29 except that the data it temporarily stores is eight times the character code. Register 40 is the base address register and receives an input from microprocessor 10 which tells where in the random access memory the start address for the virtual screen is located. Register 40 provides an output to bus 22. Register 41 is a vertical offset register and receives an input from MPU 10 and provides an output to bus 22. Register 41 contains the information on how far to start from the top edge of the virtual screen. This information is needed to know where to start the real screen display. The information is also used for panning and if it is changed or updated by MPU 10 then vertical scrolling can be achieved. Register 42 contains the information for the horizontal offset and receives this input from MPU 10 and provides an output to bus 22. Horizontal offset register 42 contains the information on how far to start from the side edge of the virtual screen. The vertical offset information along with the horizontal offset information defines the starting point for panning and by changing the information in these two registers vertical and horizontal scrolling can be achieved. Register 43 is a vertical size register and receives inputs from MPU 10 and provides an output to bus 22. Register 44 is a horizontal size register and receives inputs from MPU 10 and provides an output to bus 22. Vertical size register 43 and horizontal size register 44 indicate the size of the virtual screen which is selected by MPU 10. Register 45 contains the negative value of the horizontal size. Register 45 receives inputs from MPU 10 and provides an output to bus 22. The negative value of the horizontal size is used quite frequently in calculating addresses and therefore register 45 is specifically dedicated to contain a negative value of the horizontal size in order to reduce the time required for generating addresses. Register 46 receives its input from the output of ALU 20 and temporarily stores this output as an intermediate value. Register 46 provides an output to bus 22. Display address generator 11 is illustrated as having an arithmetic and logic unit 20 however in this implementation a full adder could also be used.

The display address generator illustrated in FIG. 2 is controlled by microcode which may be implemented, for example, as a ROM 16 contained in video generator 13. A simplified example of how the display address generator works will be explained, assuming that noninterlaced bit plane mode of display has been selected. Before the beginning of each raster line, the horizontal size (stored in register 44) is added to the value stored in RV register 30. This is done to keep track of the vertical position within the virtual screen. Then the vertical offset from register 41 and the value stored in RV register 30 are added and loaded into current address register 33. At this time another portion of the video display control system is checked to determine if vertical wrap around has occurred, and if it has, then a flag is set within the video display control system. Now the base address from register 40 is added to the contents in current address registor 33. If the vertical wrap around flag was set, the vertical size contents stored in register 43 is subtracted from the current address value in register 33 and the result is stored in current address regiser 33. The value now stored in current address register 33 is the vertical component of the final address.

The above calculations are performed once per scan line. The following calculations are performed once per memory cycle and are done to obtain the horizontal component. The number of bytes to be accessed for the video to be displayed is added to the contents stored in Q register 31. This keeps track of the horizontal position within the virtual screen. Next the horizontal offset in register 42 is added to Q register 31 and the results are stored in intermediate value registers 32 and 46. Now a check for horizontal wrap around is made and if wrap around has occurred a horizontal wrap around flag is set. Next, the previously calculated current address (see previous paragraph) is added to the intermediate value from register 46 unless the horizontal wrap around flag is set. If horizontal wrap around flag is set then the horizontal size in register 44 is subtracted from the intermediate value stored in register 32. The answer obtained is the final video address.

The memory cycle is divided up into nine time slots which are used in generating addresses. As an example of how these nine time slots are used, a short address equation will be solved. Assume that the list mode has been selected and a dynamically redefinable character will be addressed. Also assume that the character will have ten lines per row and further assume that the next solution needed is for the fifth line of the character. The address, R, equation would appear as follows:

R = Start Address + (((Char·Code·Lines Per Row) + Current Line)·Bits Per Pel).

Now assuming that the start address is 1024, character code is 16, lines per row is 10, current line is 5, and bits per pel is 2 the answer would equal 1354. The display address generator of FIG. 2 would solve the equation as follows:

| Time Slot | Function |
|---|---|
| 1 | CC · 2 + CC · 8 → Intermediate Value |
| 2 | Intermediate Value + Current Line → Intermediate Value |
| 3 | 2 · Intermediate Value → Intermediate Value |
| 4 | Intermediate Value + Redefinable character Start → Result |
| 5 | NOP |
| 6 | NOP |
| 7 | NOP |
| 8 | NOP |
| 9 | NOP |

The registers utilized to accomplish the above would be as follows:

| Time Slot | |
|---|---|
| 1 | Register 28 + Register 39 → Registers 32 and 46 |
| 2 | Register 46 + Register 27 → Registers 32 and 46 |
| 3 | Register 32 + Register 46 → Registers 32 and 46 |
| 4 | Register 46 + Register 26 → Result |
| 5 | NOP |
| 6 | NOP |
| 7 | NOP |
| 8 | NOP |
| 9 | NOP |

In time slot 1 the display address generator sums the character code times two with the character code times eight which is the same as multiplying the character code by ten. After each result is obtained both intermediate value registers 32 and 46 are loaded with the output from ALU 20. The result is the address generated at output 23. Time slots 5 through 9 have no operation (NOP) since the equation was solved within four time slots and therefore the extra time slots were not needed. The memory cycle was arbitrarily divided into nine time slots which was a convenient division for the system shown in FIG. 1 and provides a sufficient number of time slots to solve the address equations.

The order in which the display address generator calculates addresses can be divided up into zones, wherein the center zone is a real time video access zone. The left most zone would be where calculations are done to fill the true object registers (not shown), and to the right of that zone is a refresh zone followed by an NOP zone. Continuing to the right in the same manner as a raster scan, the next zone would be the real time video zone followed to the right by a zone where calculations are done to calculate the values required for the list buffer registers (not shown). This zone is followed by another true object calculation followed by a refresh zone and another true object calculation zone. In other words the zones occupy a specific place in the raster scan field. The raster scan field begins to the left of the active video area as a blanking region, a border region, then the active video region, followed by a border region, a blanking region, and a sync region. The vertical raster field is similarly arranged by having vertical blanking and retrace occurring at the very top followed by vertical border, active video line region, another vertical border below the active video lines region, vertical blanking, and finally vertical sync.

The general equation for an address of any pel on the real screen is as follows:

$$A_{TPB} = B + W_V \cdot P\begin{bmatrix} (\Delta I + \Delta V + cl) \ldots \text{if } (\Delta I + \Delta V + cl) \leqq L_V \\ \text{OR} \\ (\Delta I + \Delta V + cl) - L_V \ldots \text{if } (\Delta I + \Delta V + cl) > L_V \end{bmatrix} + P\begin{bmatrix} (\Delta H + Cp) \ldots \text{if } (\Delta H + Cp) \leqq W_V \\ \text{OR} \\ (\Delta H + Cp) - W_V \ldots \text{if } (\Delta H + Cp) > W_V \end{bmatrix}.$$

Where $A_{TPG}$ means the address for a general target pel, B is the base video address, P is the bytes per pel, $W_V$ equals virtual width, ΔI equals one or zero interlace offset, cl equals the current line on the real screen, ΔH equals the horizontal offset, CP is the current pel on the real screen, and ΔV equals the vertical offset. Since the virtual screen is assumed to be in a wrap around configuration the terms in the brackets vary when wrap around occurs. The above equation is expressed for maximum convenience to the software programmer; however, this equation can be modified for hardware simplicity. The modification was illustrated in the examples given hereinbefore. Although the general equation is expressed in bytes, resolution to one bit is preserved.

By now it should be appreciated that there has been provided a new and improved display address generator useful in a raster display system which alleviates the burden typically placed upon microprocessors in a display system and results in added capabilities such as horizontal and vertical scrolling within a virtual screen.

We claim:

1. A raster display address generator comprising: an arithmetic and logic unit for generating raster display addresses at an output; a first and a second bus each coupled to the arithmetic and logic unit; a first set of registers coupled to the first bus for receiving at least base address, vertical size and horizontal size inputs from a microprocessor; at least one register coupled to the first bus for receiving inputs from a memory; at least one register coupled to the first bus for receiving and storing the output from the arithmetic and logic unit; at least one register coupled to the second bus for receiving start inputs from the microprocessor; at least one register coupled to the first bus for receiving character code inputs from a video data generator; at least one register coupled to the second bus for receiving a video timing input; at least one register coupled to the second bus for receiving inputs from the video data generator; and a second set of registers coupled to the second bus for receiving inputs from the output of the arithmetic and logic unit.

2. The raster display address generator of claim 1 further including means for placing zeros on the second bus so that zeros can be combined with contents from one of the registers coupled to the first bus when it is desired to transfer the contents from said one of the registers coupled to the first bus, to a register that is coupled to the output of the arithmetic and logic unit.

3. The raster display address generator of claim 1 wherein the at least one register coupled to the first bus for receiving the output from the arithmetic and logic unit is used to temporarily store the output from the arithmetic and logic unit so that it can be added to contents from one of the registers coupled to said second bus if desired.

4. The raster display address generator of claim 1 wherein the arithmetic and logic unit is a full adder.

5. The raster display address generator of claim 1 wherein at least two of the registers of the first set of registers are for receiving vertical offset and horizontal offset information so that the raster display address generator can provide addresses useful in scrolling in both vertical and horizontal directions.

6. A raster display address generator for generating addresses for a video display system having a microprocessor, memory, and a video generator, comprising: first means for combining coupled to said microprocessor, said memory, and said video generator; means for providing a base address coupled to the first means; means for providing horizontal offset data coupled to the first means; means for providing vertical size data coupled to the first means; means for providing horizontal size data coupled to the first means; means for temporarily storing an output from the first means and being coupled back to the first means; means for providing current raster line location coupled to the first means; and means for providing a current address of the raster display address generator coupled to the first means.

7. The raster display address generator of claim 6 wherein the first means is an arithmetic and logic unit.

8. A raster display system having a microprocessor, video timing circuit, memory, video generator, video display, and a display address generator, the display address generator comprising: a dedicated arithmetic and logic unit for generating raster display addresses; a first register for receiving a base address from the microprocessor being controllably coupled to the arithmetic and logic unit; a current line register for receiving a current raster line from the video timing circuit and being controllably coupled to the arithmetic and logic unit; a register for receiving vertical offset data from the microprocessor being controllably coupled to the arithmetic and logic unit; a register for receiving horizontal offset data from a microprocessor and being controllably coupled to the arithmetic and logic unit; and a register coupled to the output of the arithmetic and logic unit for temporarily storing the output and being controllably coupled to the input of the arithmetic and logic unit.

9. The raster display system of claim 8 further including a register for receiving horizontal size data from the microprocessor and being controllably coupled to the arithmetic and logic unit; and a register for receiving vertical size data from the microprocessor and being controllably coupled to the arithmetic and logic unit.

* * * * *